US011566757B2

(12) United States Patent
Slovák

(10) Patent No.: US 11,566,757 B2
(45) Date of Patent: Jan. 31, 2023

(54) METHOD OF OPERATING A LIGHT DISPLAY DEVICE

(71) Applicant: Safestuffs group s.r.o., Tajná (SK)

(72) Inventor: Igor Slovák, Tajná (SK)

(73) Assignee: Safestuffs group s.r.o., Tajná (SK)

( * ) Notice: Subject to any disclaimer, the term of this patent is extended or adjusted under 35 U.S.C. 154(b) by 0 days.

(21) Appl. No.: 17/476,056

(22) Filed: Sep. 15, 2021

(65) Prior Publication Data

US 2022/0397246 A1 Dec. 15, 2022

(30) Foreign Application Priority Data

Jun. 10, 2021 (SK) ..... 50035-2021

(51) Int. Cl.
*F21L 4/02* (2006.01)
*H05B 45/00* (2022.01)
*F21V 23/00* (2015.01)

(52) U.S. Cl.
CPC ..... *F21L 4/02* (2013.01); *F21V 23/005* (2013.01); *H05B 45/00* (2020.01)

(58) Field of Classification Search
CPC ..... F21L 4/02; F21V 23/005; H05B 45/00
See application file for complete search history.

(56) References Cited

U.S. PATENT DOCUMENTS 5,079,679 A 1/1992 Chin-Fa
5,748,157 A 5/1998 Eason
6,265,984 B1 7/2001 Molinaroli
6,404,409 B1 6/2002 Solomon
2003/0080924 A1 5/2003 Bentley
2004/0222428 A1 11/2004 Shimomura et al.
2011/0007496 A1 1/2011 Chien
2015/0029701 A1 1/2015 Weidman et al.
2015/0255012 A1 9/2015 Gu et al.
2016/0209728 A1* 7/2016 Shatz ..... F21L 4/02
(Continued)

FOREIGN PATENT DOCUMENTS

DE 20 2006 007 178 U1 9/2006
DE 20 2008 009 828 U 10/2008
EP 0 546 844 A2 6/1993
(Continued)

OTHER PUBLICATIONS

European Search Report in EP 18 475 504.9, completed Jan. 9, 2019.

*Primary Examiner* — Kevin Quarterman
(74) *Attorney, Agent, or Firm* — Collard & Roe, P.C.

(57) ABSTRACT

At least one of a selected animation an image and a character are displayed by vertical oscillation of a hand at a horizontal position of a light display device. In the horizontal position of the hand and also in the horizontal position of the light display device, a slider animation (directional arrow) is displayed without oscillation. When the light display device is upright, the device illuminates a red warning light on both sides. An illuminating device is switched on to display at least one of text, animation and a character by means of horizontal oscillation. When the light display device is caught from the right hand to the left, the displayed text, animation or character is automatically rotated to a readable position. When the device is lowered to the vertical position, the display is automatically interrupted.

3 Claims, 3 Drawing Sheets

(56) References Cited

U.S. PATENT DOCUMENTS

| | | | | |
|---|---|---|---|---|
| 2017/0036105 | A1 | 2/2017 | Barney et al. | |
| 2021/0112647 | A1* | 4/2021 | Coleman ..... | H05B 47/11 |

FOREIGN PATENT DOCUMENTS

| | | | |
|---|---|---|---|
| GB | 2 416 314 | A | 1/2006 |
| GB | 2 451 234 | B | 8/2009 |
| WO | 2008/117280 | A2 | 10/2008 |

* cited by examiner

METHOD OF OPERATING A LIGHT DISPLAY DEVICE

CROSS REFERENCE TO RELATED APPLICATIONS

Applicant claims priority under 35 U.S.C. § 119 of Slovak Patent Application No. PP 50035-2021 filed Jun. 10, 2021, the disclosure of which is incorporated by reference.

BACKGROUND OF THE INVENTION

Field of the Invention

The invention relates to a method of operating a light display device which, when moving, produces text, inscriptions or images by lighting the LEDs.

Background of the Invention

The best known and oldest solution is spinning the rod, the ends of which are covered with fabric and it is soaked in a flammable cloth. By igniting and juggling such a rod, the illusion of a fire ring is created.

A more modern display device is a rod equipped with static lighting elements, where the illusion of light static circles is created when the rod is rotated.

The document DE202008009828U describes a graphic rod with batteries and LED lights and a control unit which creates various patterns when rotated. This rod contains a number of components and its production is costly.

The document U.S. Pat. No. 5,079,679 A discloses a multi-purpose stick for controlling traffic on the road.

The stick has a special design on the inner and outer wall to optimize the effect of the stick's convergence. There is a flashlight at the end of the handle. In addition, it is equipped with a speaker and a lamp (neon UV lamp or aligned UV LED strips). In addition to the constant lighting, the bulb tube will serve as a control rod and may have a flashing effect, which serves the purpose of a warning light behind the vehicle in the event of an accident or engine failure.

The speaker can make a whistle sound (electronic whistle).

The document US2015029701 describes a traffic control light stick which contains batteries, luminaires whose effect is multiplied by reflective surfaces.

All the described solutions from the prior art contain a number of disadvantages, in particular the complex construction and use of complicated components or they are the solutions which are not programmable.

SUMMARY OF THE INVENTION

The shortcomings mentioned in the prior art are eliminated by the solution described in this application, the essence of which is a method of controlling a light display device which serves to display signs and images in motion in such a way that the graphic display device leaves the image transmitted by this device in its motion in the eye.

Method of operating a light display device consisting of a housing made of solid transparent material at one end equipped with a metal spike to break the window, while the package contains a battery, LED RGB diodes, LED UV diodes, 3 W CREE LED diode, processor, tactical light, light scattering rings, an electric contact and firing paralyser and a laser infrared pyrometer, where the package is provided with a chain or cord for gripping or with a handle or handles perpendicular to the longitudinal axis of the device, a processor connected to a GPS module and metal detector, gyroscope and accelerometer, and an USB connector also connected to a charging unit with a battery charge indicator connected to a DC battery and a DC/DC converter, further is the processor connected to three LED controllers which are connected to a DC/DC converter and the LED controller is connected to 71 RGB LEDs, the LED driver is connected to 6 pieces of UV LEDs, the LED driver is connected to a 3 W CREE LED, while next to the USB connector, a wifi and/or bluetooth module is connected to the connection for the wireless connection and/or interconnection of several lighting devices with a control, which is adapted to determine the main lighting device and the auxiliary lighting devices, is characterized in that:

- the selected animation and/or the image and/or the character are displayed by the vertical oscillation of the hand at the horizontal position of the light display device;
- in the horizontal position of the hand and also in the horizontal position of the light display device, a slider animation (directional arrow) is displayed without oscillation;
- when the light display device is upright, the device shall illuminate with a red warning light on both sides.

When the illuminating device is switched on to display text and/or animation and/or a character by means of horizontal oscillation:

- when the light display device is caught from the right hand to the left, the displayed text and/or animation and/or character is automatically rotated to a readable position;
- when the device is lowered to the vertical position, the display is automatically interrupted and, by moving it again to the horizontal oscillation position or to the vertical up position, the light display device starts and continues the interrupted display, remembering the last animation and/or image and/or character used.

The light display device shall be connected by wireless technology to other lighting devices, and one of the devices shall be designated as "Master" and the other as "Slave", with the light display device designated as "Master" issuing commands to the other display devices designated as "Slave" for displaying colours, animations, gradual light effects, flashing lights, and warning lights.

BRIEF DESCRIPTION OF THE DRAWINGS

Other objects and features of the invention will become apparent from the following detailed description considered in connection with the accompanying drawings. It is to be understood, however, that the drawings are designed as an illustration only and not as a definition of the limits of the invention.

In the drawings.

DETAILED DESCRIPTION OF PREFERRED EMBODIMENTS

Figure 1:
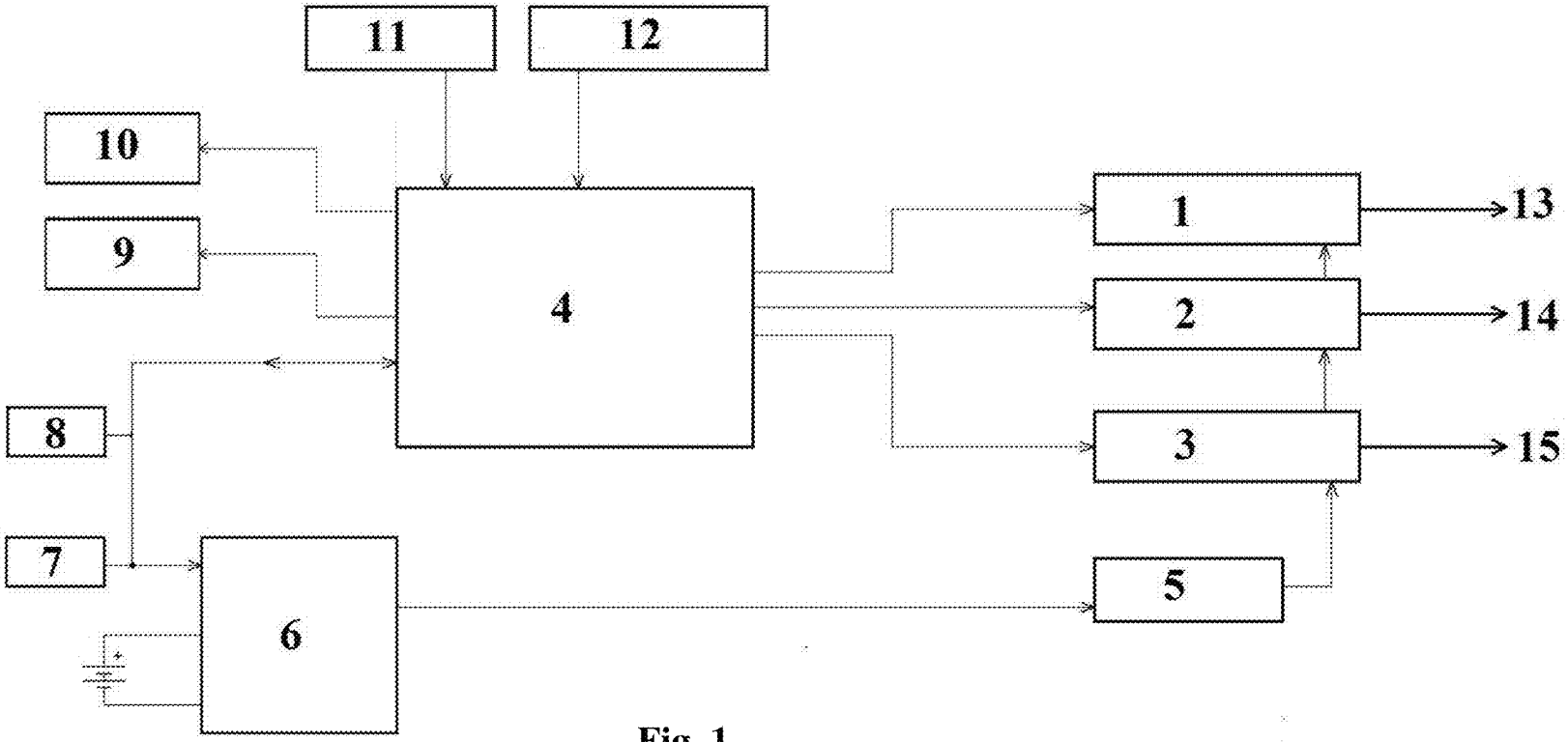
FIG. 1 shows a connection located in a graphic display device.
Figure 2:
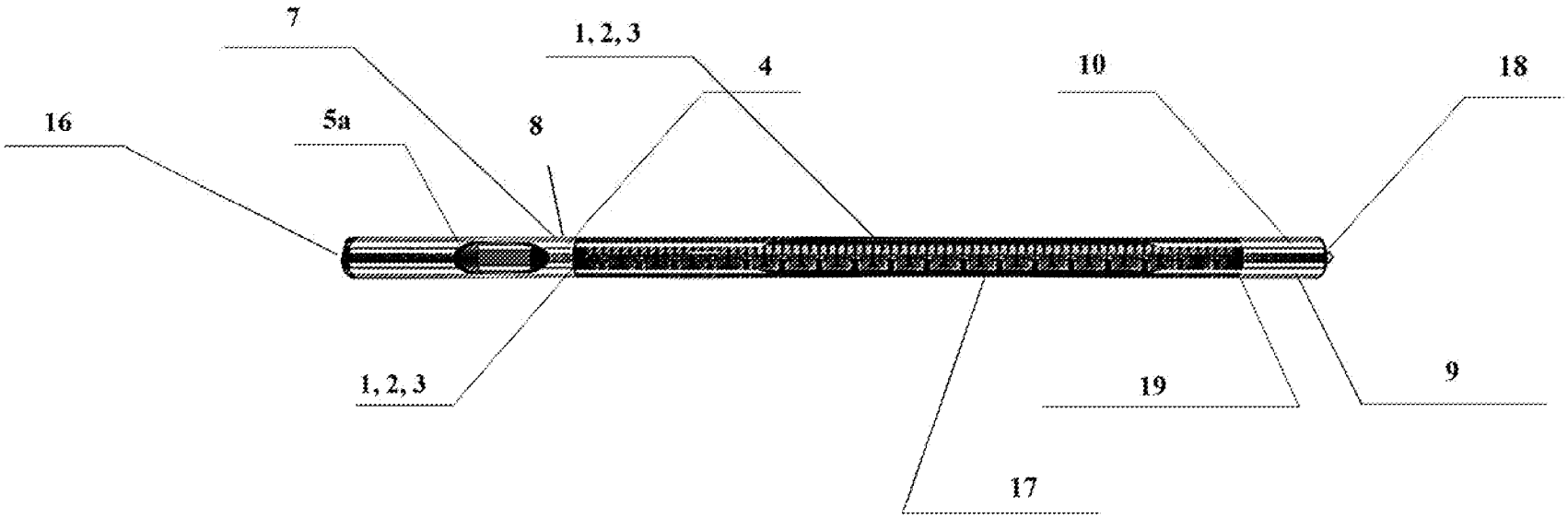
FIG. 2 shows a display device.
Figure 3:
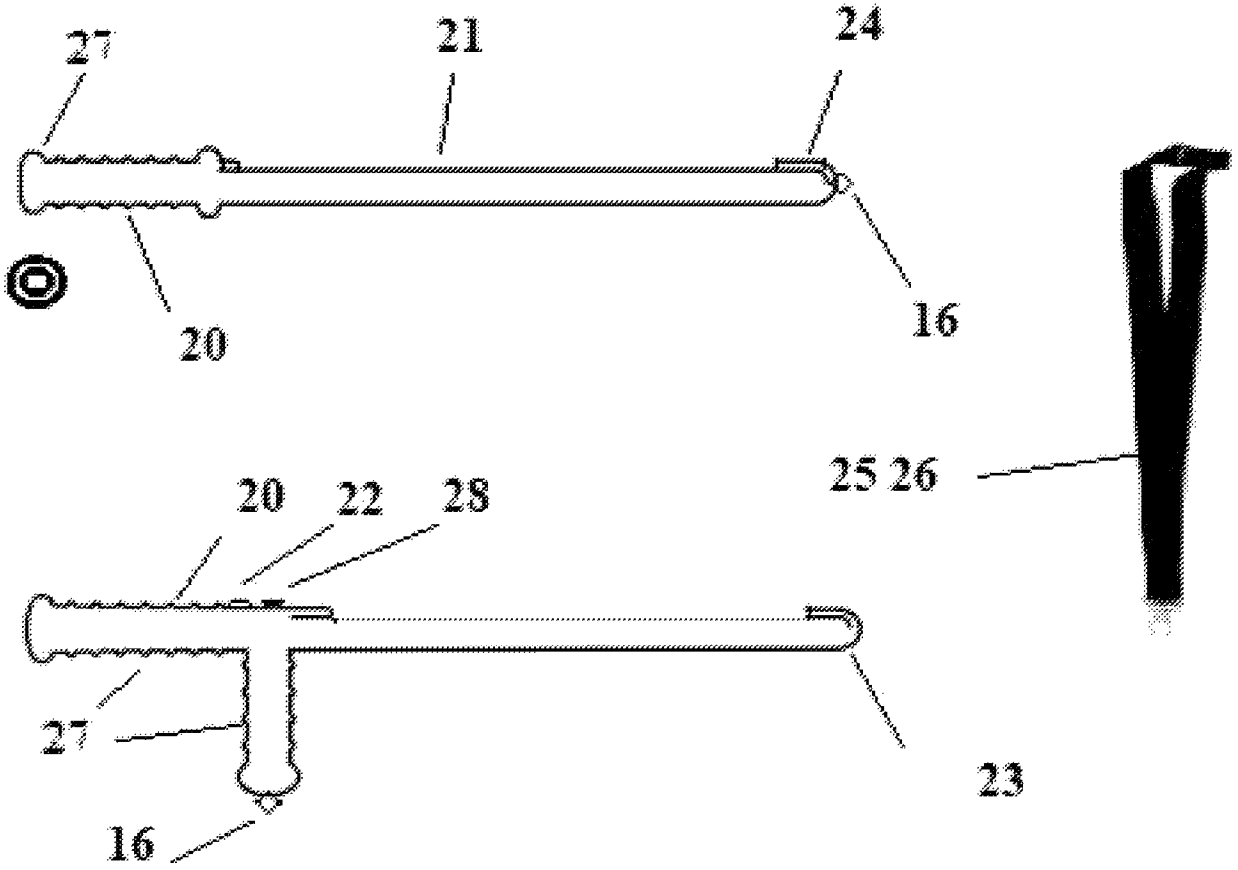
FIG. 3 shows display devices.

The light display device serves to display signs and images in motion in such a way that the display device leaves the image transmitted by this device in its motion in the eye.

This device is hung on a chain (25) which is held on the fingers and rotates with it, producing an image which is pre-programmed or is held by a handle (27) or a handle perpendicular to the longitudinal axis of the device.

The light display device is powered by rechargeable batteries 5*a* and the software is specially designed for this device.

Method of operating a light display device consisting of a housing (17) made of solid transparent material at one end equipped with a metal spike (16) to break the window, while the package contains a battery, LED RGB diodes, LED UV diodes, 3 W CREE LED diode, processor, tactical light (18), light scattering rings (21), an electric contact and firing paralyser (23 and a laser infrared pyrometer 24), where the package is provided with a chain 25 or cord 22 for gripping or with a handle 27 or handles perpendicular to the longitudinal axis of the device, a processor (4) connected to a GPS module (10) and metal detector (9), gyroscope (11) and accelerometer (12), and an JACK connector (7) also connected to a charging unit (6) with a battery charge indicator (19) connected to a DC battery (5*a*) and a DC/DC converter (5), further is the processor (4) connected to three LED controllers (1, 2, 3) which are connected to a DC/DC converter (5) and the LED controller (1) is connected to 71 RGB LEDs (13), the LED driver (2) is connected to 20 pieces of UV LEDs (14), the LED driver (3) is connected to a 3 W CREE LED (15), while next to the USB connector (7), a wifi and/or bluetooth module (8) is connected to the connection for the wireless connection (28) and/or interconnection of several lighting devices with a control, which is adapted to determine the main lighting device and the auxiliary lighting devices, is characterized in that:

- the selected animation and/or the image and/or the character are displayed by the vertical oscillation of the hand at the horizontal position of the light display device;
- in the horizontal position of the hand and also in the horizontal position of the light display device, a slider animation (directional arrow) is displayed without oscillation;
- when the light display device is upright, the device shall illuminate with a red warning light on both sides.

When the illuminating device is switched on to display text and/or animation and/or a character by means of horizontal oscillation:

- when the light display device is caught from the right hand to the left, the displayed text and/or animation and/or character is automatically rotated to a readable position;
- when the device is lowered to the vertical position, the display is automatically interrupted and, by moving it again to the horizontal oscillation position or to the vertical up position, the light display device starts and continues the interrupted display, remembering the last animation and/or image and/or character used.

The light display device shall be connected by wireless technology to other lighting devices, and one of the devices shall be designated as "Master" and the other as "Slave", with the light display device designated as "Master" issuing commands to the other display devices designated as "Slave" for displaying colours, animations, gradual light effects, flashing lights, and warning lights.

INDUSTRIAL USABILITY

The light display device serves as a tool for regulating traffic and regulating the movement of people during the organization of social events or demonstrations. This device allows the creation of a number of light variations of patterns and texts depending on the computer program used. It can also serve as a lighting aid for, for example, armed and police and rescue services for the purpose of traffic lights or traffic control (accident, transfer of equipment, construction work, etc.) Also in the photo industry, for photography using a technique called lightpainting or painting with light.

Although only a few embodiments of the present invention have been shown and described, it is to be understood that many changes and modifications may be made thereunto without departing from the spirit and scope of the invention.

LIST OF REFERENCE NUMBERS (1) LED controller
(2) LED controller
(3) LED controller
(4) Processor
(5) DC/DC converter
(5*a*) DC battery
(6) charging unit
(7) USB connector
(8) wifi and/or bluetooth module
(9) metal detector
(10) GPS module
(11) gyroscope
(12) accelerometer
(13) RGB LED
(14) UV LED
(15) 3 W CREE LED
(16) metal spike
(17) housing
(18) tactical light
(19) battery charge indicator
(20) package
(21) light scattering rings
(22) electric contact
(23) firing paralyser
(24) laser infrared pyrometer
(25) chain
(26) cord
(27) handle
(28) wireless connection

What is claimed is:

1. A method of operating a light display device comprising a housing made of solid transparent material having first and second ends;

a metal spike at the first end of the housing configured to break a window;

a battery disposed in the housing;

a plurality of LED RGB diodes disposed in the housing;

a plurality of LED UV diodes disposed in the housing;

a 3 W LED diode disposed in the housing;

a processor disposed in the housing;

a tactical light disposed in the housing;

a plurality of light scattering rings disposed in the housing;

an electric contact and firing disposed in the housing; and a laser infrared pyrometer disposed in the housing;

a chain or cord for gripping provided on the housing or a handle or handles perpendicular to a longitudinal axis of the housing;

wherein the processor is connected to a GPS module, metal detector, a gyroscope, and an accelerometer; and a USB connector connected to a charging unit with a battery charge indicator connected to a DC battery and a DC/DC converter;

wherein the processor is connected to first, second, and third LED controllers connected to the DC/DC converter; and wherein the first LED controller is connected to 71 LED RGB diodes of the plurality of LED RGB diodes, the second LED controller is connected to 6 pieces of LED UV diodes of the plurality of LED UV diodes;

wherein the third LED controller is connected to the 3 W LED diode;

wherein next to the USB connector, a wifi and/or bluetooth module is connected to a connection for a wireless connection and/or an interconnection of a plurality of auxiliary lighting devices to a control adapted to control the light display device as a main lighting device and the auxiliary lighting devices;

wherein the method comprises:

displaying selected animation and/or an image and/or a character by a vertical oscillation of a hand at a horizontal position of the light display device;

displaying, when the hand is in a horizontal position of the hand and the light display device is in the horizontal position without oscillation, a slider animation comprising a directional arrow; and illuminating a red warning light on the first and second ends of the housing when the light display device is upright.

2. The method of operating a light display device according to claim 1, further comprising switching on the light display device to display text and/or animation and/or a character by a horizontal oscillation of the light display device;

wherein when the light display device is switched on to display the text and/or the animation and/or the character by the horizontal oscillation:

automatically rotating the text and/or the animation and/or the character so displayed to a readable position when the light display device is caught from the right hand to the left; and automatically interrupting display when the light display device is lowered to a vertical position, and continuing the display of the animation and/or the image and/or the character from a point of interruption by moving the light display device again to a horizontal oscillation position or to a vertical up position.

3. The method of operating a light display device according to claim 1, wherein the light display device is connected by wireless technology to the auxiliary lighting devices; and wherein the method further comprises:

designating the main lighting device as "Master" and the each of the auxiliary lighting devices as "Slave", with the main lighting device designated as "Master" issuing commands to the auxiliary lighting devices designated as "Slave" for displaying colors, animations, gradual light effects, flashing lights, and warning lights.

* * * * *